US005083335A

United States Patent [19]

Krouskop et al.

[11] Patent Number: 5,083,335

[45] Date of Patent: Jan. 28, 1992

[54] PRESSURE REDUCTION FOAM MATTRESS SUPPORT

[76] Inventors: Thomas A. Krouskop, 11915 Meadowtrail La., Stafford, Tex. 77477; Daniel J. Schaefer, 717 Woodward Way, Atlanta, Ga. 30327

[21] Appl. No.: 667,142

[22] Filed: Mar. 11, 1991

[51] Int. Cl.[5] ..... A47C 27/14

[52] U.S. Cl. ..... 5/464; 5/468; 5/481

[58] Field of Search ..... 5/446, 464, 468, 481

[56] References Cited

U.S. PATENT DOCUMENTS

| | | | |
|---|---|---|---|
| 2,617,751 | 11/1952 | Bickett . | |
| 2,835,313 | 5/1958 | Dodge | 5/481 X |
| 2,953,195 | 9/1960 | Turck, Jr. | 5/481 X |
| 3,403,414 | 10/1968 | Unger . | |
| 3,885,257 | 5/1975 | Rogers . | |
| 4,106,139 | 8/1978 | Southard | 5/481 X |
| 4,397,053 | 8/1983 | Fanti . | |
| 4,524,473 | 6/1985 | Fanti . | |
| 4,679,266 | 7/1987 | Kraft . | |
| 4,682,538 | 9/1989 | Spann et al. | 5/464 |
| 4,713,854 | 12/1987 | Graebe . | |
| 4,793,574 | 12/1988 | Fenske et al. . | |
| 4,796,316 | 1/1989 | Boselli | 5/468 X |
| 4,930,173 | 6/1990 | Woller . | |

FOREIGN PATENT DOCUMENTS

| | | | |
|---|---|---|---|
| 0062915 | 10/1981 | European Pat. Off. | 5/468 |
| 2588846 | 4/1987 | France | 5/481 |
| 863014 | 3/1961 | United Kingdom | 5/481 |

*Primary Examiner*—Michael F. Trettel
*Attorney, Agent, or Firm*—Fulbright & Jaworski

[57] ABSTRACT

A foam mattress support having a top, intermediate and bottom layer. The intermediate layer includes a plurality of ribs having a cross-sectional area increasing in the direction perpendicular to the pad, the height of the ribs being at least as great as one-third of the thickness of the pad, and the cross-sectional area of the ribs at the head and foot end being substantially equal but being less than the cross-sectional area of the ribs between the head and foot ends.

9 Claims, 3 Drawing Sheets

TYPICAL LOAD/DEFORMATION CURVES

PRESSURE REDUCTION FOAM MATTRESS SUPPORT

BACKGROUND OF THE INVENTION

The present invention is directed to a foam overlay or mattress for supporting a human body. The foam support or pad provides a support surface that can accommodate the different support required by different segments of the body. The support or pad is designed to control the posture of the user and the interface pressures that are generated while lying on the pad.

Mattresses are important tools for use in preventing pressure sores and pressure-induced soft tissue damage, maintaining proper body alignment for comfort, minimizing peak pressures, and controlling the pressure gradients across the skin. Various types of foam rubber or rubber-like materials, either synthetic or natural occurring materials, have been used in the past in which the geometry and/or density of the foam was varied in order to properly support a body.

The present invention is directed to a foam support having a top layer with a smooth surface, a bottom layer and an intermediate layer that provides a variable support characteristic. The normal load-deformation characteristic of the intermediate foam is layer modified to produce regions that deform through a controlled distance with only a slight increase in load, other regions that deform less to provide greater support, and other regions providing still greater support to prevent the user from bottoming out. Thus, the present invention provides a foam support to obtain a better reaction to the support surface, better enhances the foam is pressure reduction performance and provides lower interface pressures because of its construction.

SUMMARY

The present invention is directed to a foam mattress pad support for supporting a human body in which the pad includes a length having a head end and a foot end, a width, and a thickness. The support includes a top layer, a bottom layer, and an intermediate layer positioned between the top layer and the bottom layer. The top layer includes a smooth continuous surface for ease in moving a body on the surface or making transfers of the body to other objects. The intermediate layer includes a plurality of ribs positioned transversely to the longitudinal axis of the length and the ribs are separated from each other by cavities. The cross-sectional area of the ribs increases in a direction perpendicular to the top layer and the height of the ribs is at least as great as one-third of the thickness of the pad. The thinner cross-sectional areas of the ribs provide additional deformation which is controlled by buckling to effectively support the body with a lower interface pressure. The greater cross-sectional areas provide greater stiffness to provide greater support and prevent bottoming out. The height of the ribs provides greater control of the load deformation characteristics.

Another feature of the present invention is that the cross-sectional areas of the ribs at the head end and the foot end are substantially the same and are less than the cross-sectional area of the ribs intermediate the head end and the foot end. Therefore, the head and foot sections have the same deformation characteristics since they are not required to support the greater load in the intermediate portion of the support. The contact area goes up and the pressure is reduced in the head and the foot more than in the intermediate area.

Still a further object of the present invention is wherein the height of the ribs is approximately 60% of the thickness of the support. The increased height allows the foam ribs to buckle more easily to insure lower interface pressures on the body surfaces.

Still a further object of the present invention is wherein the ribs extend across the center plane of the pad thereby providing greater height ribs. Preferably, the cross section of the ribs at the head and at the foot ends of the support include a rectangular portion and a trapezoidal portion while the preferred cross-sectional shape of the ribs intermediate the head and foot are trapezoidal shaped.

Yet a still further object of the present invention is wherein the bottom layer includes a transverse slot connected to each cavity for ease in manufacturing the cavities.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
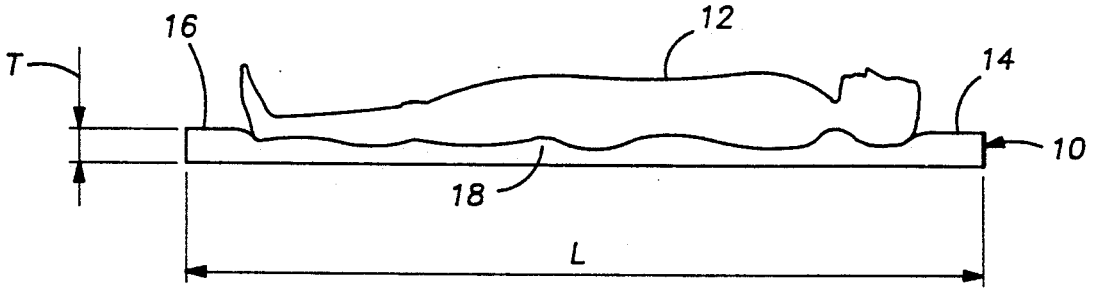
FIG. 1 is an elevational view of the support of the present invention supporting a reclining human body.
Figure 2:
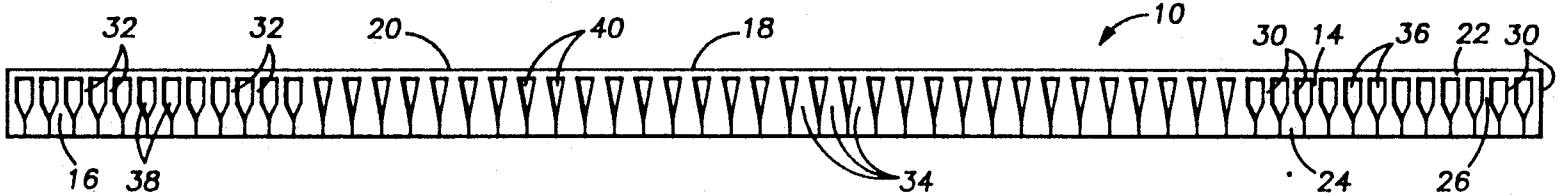
FIG. 2 is an enlarged cross section of the support shown in FIG. 1.
Figure 3:
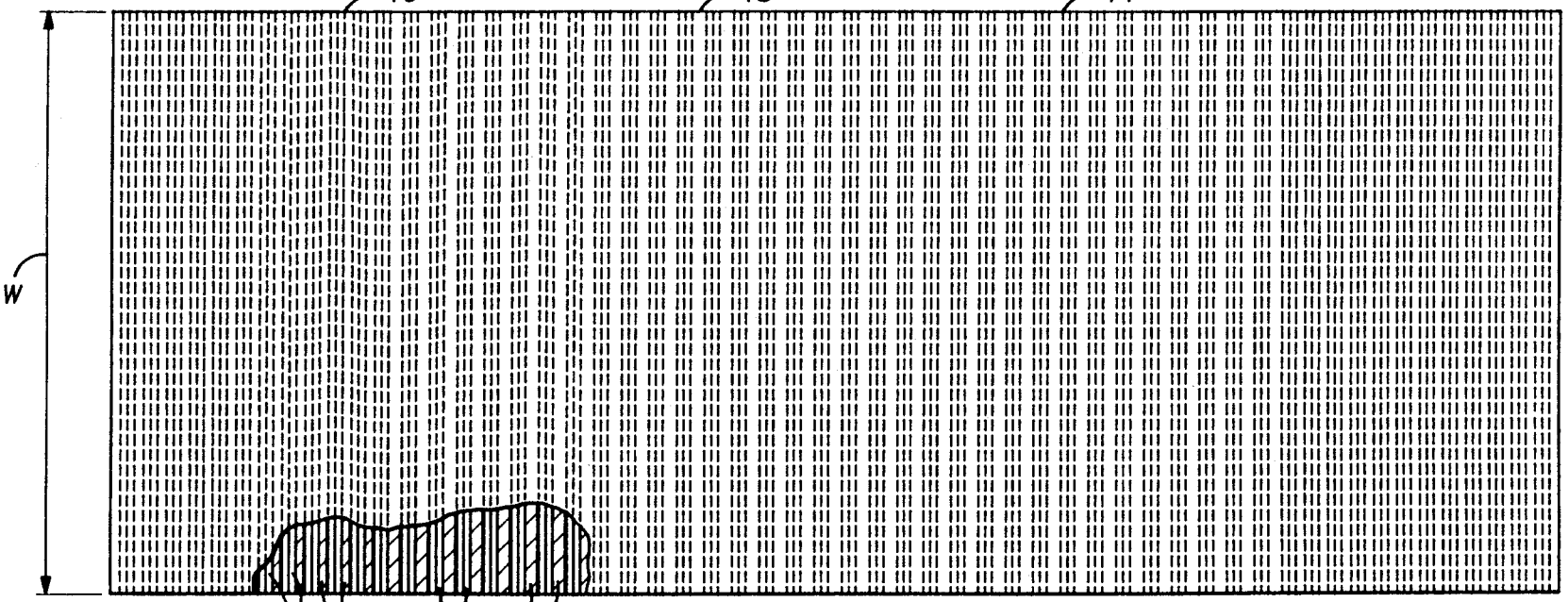
FIG. 3 is a top elevational view, partly in section, of the support of FIG. 2.

Referring now to the drawings, and particularly to FIGS. 1, 2 and 3, the reference numeral 10 generally indicates the foam support of the present invention which may be a foam overlay, a pad or a mattress for supporting a human body 12 thereon. The support 10 may be of any suitable material, such as foam rubber, or rubber-like material, and may be a synthetic or a natural material. Preferably, the material is polyurethane foam, but may be latex or urethane. The support 10 has a length L having a head end section 14 and a foot end section 16, a middle section 18 between the end section 14 and end section 16, a width W and a thickness T.

It is a well known object in mattresses to attempt to provide low interface pressures on the surfaces of the body 12. Attempts have been made to accomplish this result with foam mattresses by varying the density, providing recesses in the foam, or providing openings in the upper surface. However, the present invention has the advantage of providing a support that (1) can accommodate the different support required at the different sections 14, 16 and 18, (2) provide variable interface pressures in each of the sections 14, 16 and 18 of the support 10, while still preventing "bottoming out" and (3) can make the contact or top surface 20 smooth so that body moves or transfers on the surface are easier.

Figure 4:
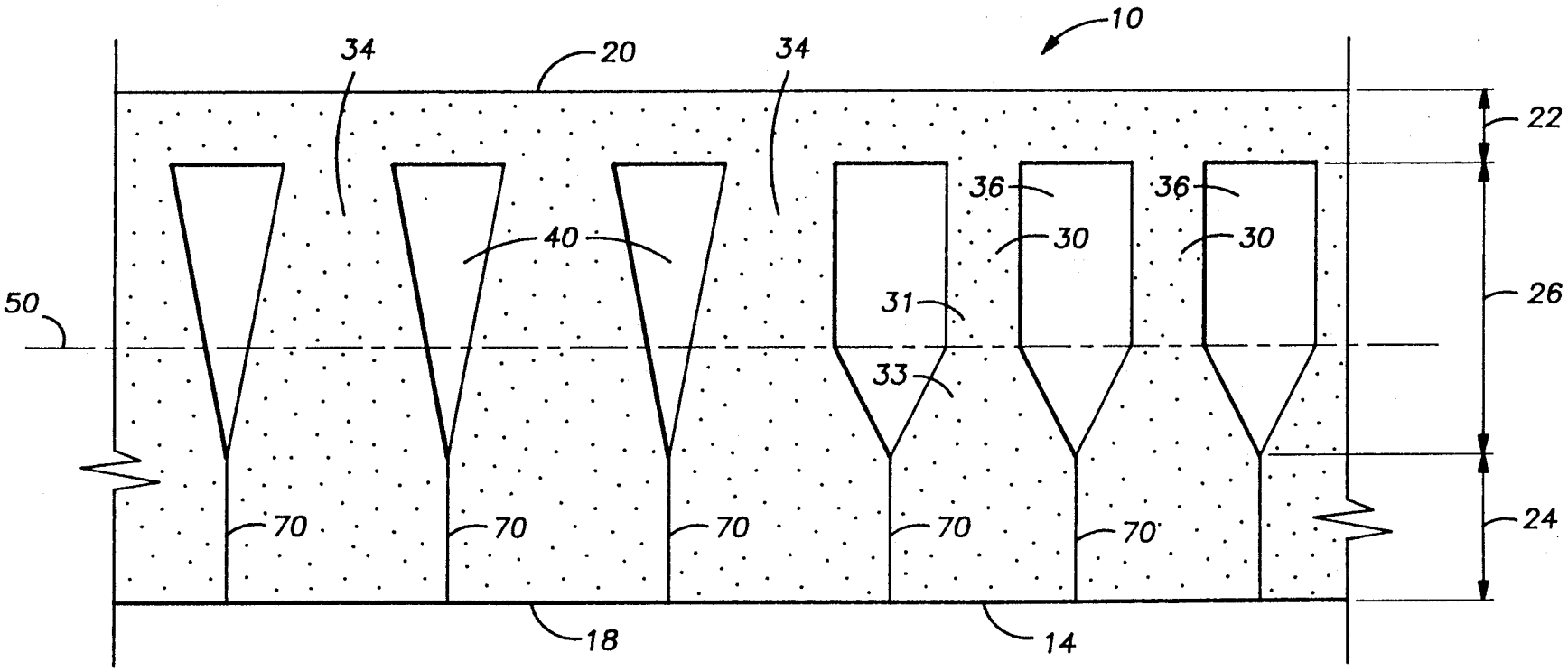
FIG. 4 is an enlarged cross-sectional view, taken along the line 4—4 of FIG. 2.

Referring now to FIGS. 2 and 4, the support 10 includes a top layer 22, a bottom layer 24 and an intermediate layer 26. The top layer 22 includes a top surface 20 which is a smooth continuous surface for ease in allowing the body 12 to move thereon or in transferring the body 12 to or from the support 10. Cut top surfaces increase the shear force required to move the user across the support surfaces. The bottom layer 24 provides a support which prevents the user from "bottoming out". Thus, the user will not rest on an immovable surface.

The intermediate layer 26 includes a plurality of ribs positioned transversely to the longitudinal axis of the length L of the support 10. The ribs are separated from each other by cavities, the cross-sectional area of the ribs increases in the direction perpendicular to the top of the support 20, and the height of the ribs is at least as great as one-third of the thickness T of the support 10. The cross-sectional area of the ribs 30 at the head end 14 of the support 20 are substantially the same as the cross-sectional area of the ribs 32 at the foot end 16 of the support 10. However, the cross-sectional area of the ribs 34 in the intermediate section 18 of the support 10 between the ends 14 and 16 is greater than the cross-sectional area of the ribs 30 and 32. That is, all of the ribs 30, 32 and 34 are positioned transversely to the longitudinal axis of the length L of the support 20. The ribs are separated from each other by cavities. Thus, the ribs 30 are separated by cavities 36, the ribs 32 are separated by cavities 38, and the ribs 34 are separated by cavities 40. However, and importantly, it is to be noted that all of the ribs 30, 32 and 34 have a cross-sectional area in the middle layer 26 between the top layer and the bottom layer 24 which increases in a direction perpendicular to the top of the support 20. This increase in the cross-sectional area can be either downwardly or upwardly, here shown as being in the downward direction. First, it is noted that the cross-sectional area of the intermediate ribs 34 is greater than the cross-sectional area of the ribs 30 and 32 as the support 10 is designed to accommodate the different supports required by the different segments of the body. That is, the middle section 18 of the support 10 is required to support the heavier torso portion of the body 12 as compared to the lighter head portions and feet portions carried by the head end 14 and foot end 16 section of the support 10. The ribs 30, 32 and 34 have a sufficient height so that they will buckle when subjected to a load and effectively support the surfaces of the body 12 with a low interface pressure. The initial deformation of the support 10 is controlled by the buckling of the ribs 30, 32 and 34, and the depth to which the ribs 30, 32 and 34 buckle is controlled by the height of the ribs. The load required to cause the foam ribs to buckle varies as the second power of the height of the ribs. Therefore, in order to effectively support the body 12 with a low interface pressure, the height of the ribs 30, 32 and 34 should be as great as one-third of the thickness T of the support 10 and preferably are as great as 60% of the thickness T of the support. Therefore, it is preferable that the height of the ribs extend across the center plane 50 (FIG. 4) of the support 10 in order to provide the desired buckling ability.

Referring now to FIG. 4, the ribs 30 and also the ribs 32, in cross section, preferably include a rectangular portion 31 and a trapezoidal portion 33. The rectangular portion 31 will initially buckle when subjected to a load to provide the low interface pressure. However, the trapezoidal portion 33 will, because of its increased cross-sectional area, provide a greater resistance to load and consequently will support a greater load as the deformation of the support 10 reaches portion 33.

And as shown in FIG. 4, the cross-sectional shape of the ribs 34 are preferably trapezoidal shaped to provide increasing resistance as the support 10 is deformed and also carry the heavier load of the torso of the body 12.

Figure 5:
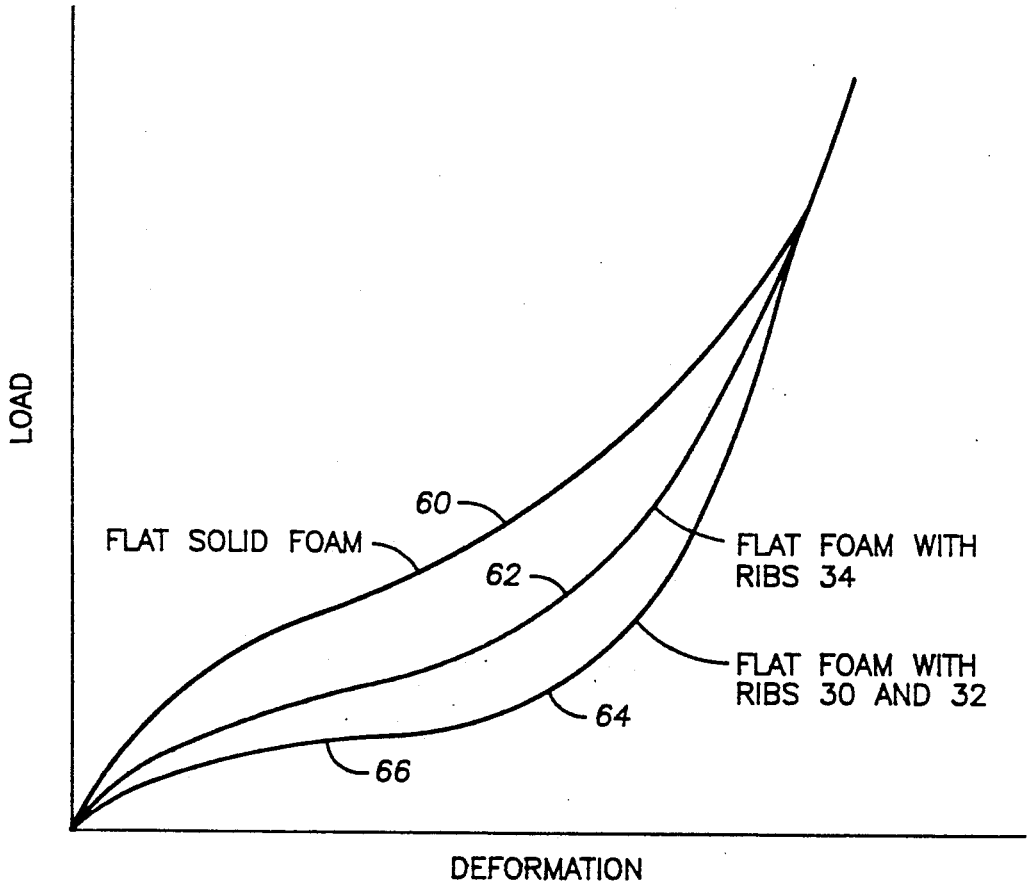
FIG. 5 is a graph of typical load-deformation curves of foam supports having different geometric cross sections.

Referring now to FIG. 5, a graph is shown of load versus deformation for various configuration of foam support sections. Graph 60 is a conventional flat solid foam support. Prior art types of support using the solid foam design had to rely upon the initial ILD of the foam and initial properties of the foam to control its support characteristics. For example only, the present support 10 is preferably made of polyurethane foam, and has a 25% ILD of 36 pounds with a density of 2 pounds/cubic foot. Graphs 62 and 64, respectively, show the load deformation characteristics of the ribs 34, and of ribs 30 and 32. In particular, it is to be noted that the load-deformation curve 64 of the foam ribs 30 and 32 has been modified to produce region 66 in the graph 64 that deforms through a substantial controlled distance with only a very slight increase in load. That is, the load-deformation curve 64 is almost flat in region 66 to provide a support that will adequately support the human body 12, but will control the interface pressures to be a minimum because of its particular geometric construction.

For example only, the total thickness T of the support 10 may be $3\frac{1}{2}$ inches, the first layer 22 has a thickness of $\frac{1}{2}$ inch, the thickness of the middle layer was 2 inches, and the thickness of the bottom layer 24 is 1 inch. As to ribs 30 and 32, the height of the rectangular portion is $1\frac{3}{4}$ inches while the height of the trapezoidal portion is $\frac{3}{4}$ of an inch. The width of the rectangular portions 31 is $\frac{1}{2}$ inch and the top base of the trapezoidal section of the ribs 34 is $\frac{3}{4}$ of an inch.

For ease in construction, the bottom layer 24 of the support 10 includes a transverse slot 70 connected to each of the cavities 36, 38, and 40. This is for ease of making the cavities.

Therefore, the present support 10 provides a smooth surface 20 to make moving and transfers on the top surface of the support 20 easier, provides initial deformation by buckling of the smaller cross-sectional areas of the ribs 30, 32 and 34 to minimize interface pressures, and thereafter increases the support capability for supporting the heavier parts of the body 12, and includes head and foot sections having the same general deformation characteristics but different from the middle section 18 for accommodating the different support requirements of the body 12.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A foam mattress pad support for supporting a human body, said pad having a length, having a head end and a foot end, a width, and a thickness comprising, a top layer and a bottom layer, and an intermediate support layer positioned between the top layer and the bottom layer, said top layer including a smooth continuous surface for ease in moving a body, said intermediate layer including a plurality of ribs positioned transversely to the longitudinal axis of the length, and having a constant cross section along their length, said ribs separated from each other by cavities, the cross-sectional area of said ribs increasing in a direction perpendicular to the top layer, and the height of the ribs being at least as great as one-third of the thickness of the support for providing deformation with only a slight increase in load, and said bottom layer being formed by lower ends of the ribs, said lower ends being separated by transverse slots that allow the lower ends to abut each other, the cross-sectional area of said ribs at the head and the foot ends being substantially the same, and being less than the cross-sectional area of the ribs between the head end and the foot end.

2. The support of claim 1 wherein the height of the ribs is approximately sixty percent of the thickness of the support.

3. The support of claim 1 wherein the ribs extend across the center plane of the support.

4. The support of claim 1 wherein the cross section of the ribs at the head and at the foot each includes a rectangular portion and a trapezoidal portion.

5. The support of claim 1 wherein the cross section of the ribs between the head and foot ends are trapezoidal shaped.

6. The support of claim 1 wherein the cross-sectional area of at least some of said ribs in a direction perpendicular to the top layer includes a constant cross-sectional area.

7. The support of claim 1 wherein the depth of the cavities in a direction perpendicular to the top layer is the same throughout the length of the support.

8. The support of claim 1 wherein the cross-sectional area of at least some of the ribs includes a constant cross-sectional portion and an increasing area portion.

9. A foam mattress pad support for supporting a human body, said pad having a length, having a head end and a foot end, a width, and a thickness comprising, a top layer and a bottom layer, and an intermediate support layer positioned between the top layer and the bottom layer, said top layer including a smooth continuous surface for ease in moving a body, said intermediate layer including a plurality of ribs positioned transversely to the longitudinal axis of the length, and having a constant cross section along their length, said ribs separated from each other by cavities, the cross sectional area of said ribs increasing in a direction perpendicular to the top layer, and the height of the ribs being at least as great as one-third of the thickness of the support for providing deformation with only a slight increase in load, and the cross sectional area of said ribs at the head and foot ends being substantially the same, and being less than the cross sectional area of the ribs between the head end and foot end, the cross section of the ribs at the head end and the foot each includes a rectangular portion and a trapezoidal portion.

* * * * *